US005118122A

United States Patent [19]

Ricart

[11] Patent Number: 5,118,122

[45] Date of Patent: Jun. 2, 1992

[54] BRAKING DEVICE FOR ROLLER SKATES AND SKATEBOARDS

[75] Inventor: Henri Ricart, Montreux, Switzerland

[73] Assignee: Leitha Finance S.A., Panama

[21] Appl. No.: 455,375

[22] PCT Filed: Apr. 14, 1989

[86] PCT No.: PCT/CH89/00071

§ 371 Date: Feb. 15, 1990

§ 102(e) Date: Dec. 19, 1989

[87] PCT Pub. No.: WO89/10169

PCT Pub. Date: Nov. 2, 1989

[30] Foreign Application Priority Data

Apr. 20, 1988 [CH] Switzerland ..... 1456/88

[51] Int. Cl.[5] ..... A63C 17/14

[52] U.S. Cl. ..... 280/11.2; 280/87.042

[58] Field of Search ..... 280/11.2, 87.042, 87.041, 280/7.13, 11.27; 188/5

[56] References Cited

U.S. PATENT DOCUMENTS

| | | | |
|---|---|---|---|
| 333,751 | 1/1886 | Harris, Jr. | 280/11.2 |
| 1,371,623 | 3/1921 | Ickenroth | 280/11.2 |
| 1,445,048 | 2/1923 | Spross | 280/11.2 |
| 1,456,881 | 5/1923 | Carley | 280/11.2 |
| 1,810,380 | 6/1931 | Van Etten | 280/11.2 |
| 2,027,487 | 1/1936 | Means | 280/11.2 |
| 4,807,893 | 2/1989 | Huang | 280/11.2 |
| 4,911,456 | 3/1990 | Sarazen | 280/11.2 |

FOREIGN PATENT DOCUMENTS

| | | | |
|---|---|---|---|
| 0039935 | 11/1981 | European Pat. Off. | 280/11.2 |
| 61514 | 8/1948 | Netherlands . | |
| 62701 | 10/1948 | Netherlands | 280/11.2 |
| 82445 | 2/1920 | Switzerland | 280/11.2 |
| 25730 | of 1909 | United Kingdom | 280/11.2 |
| 11117 | of 1910 | United Kingdom | 280/11.2 |
| 8200770 | 3/1982 | World Int. Prop. O. | 280/11.2 |

*Primary Examiner*—Andres Kashnikow
*Assistant Examiner*—Brian L. Johnson
*Attorney, Agent, or Firm*—Woodard, Emhardt, Naughton, Moriarty & McNett

[57] ABSTRACT

A braking device comprising a base element (1) secured to the frame of the skate or board by the screw which fastens the axle of the rear wheels. A lever element (9) is rotatably mounted on an axis (7) integral with the base element, and wheel (14) is rotatably mounted at one end of the lever element. Braking is effected by the other end in the form of wings (10, 10') of the lever element rubbing against each rear wheel (15) of the skate or board. The wheel (14) presses on the ground when the skate or board tilts backward. The assembly is arranged so that the lever element returns to the rest position solely under the action of the weight of the wheel.

11 Claims, 4 Drawing Sheets

Fig. 5
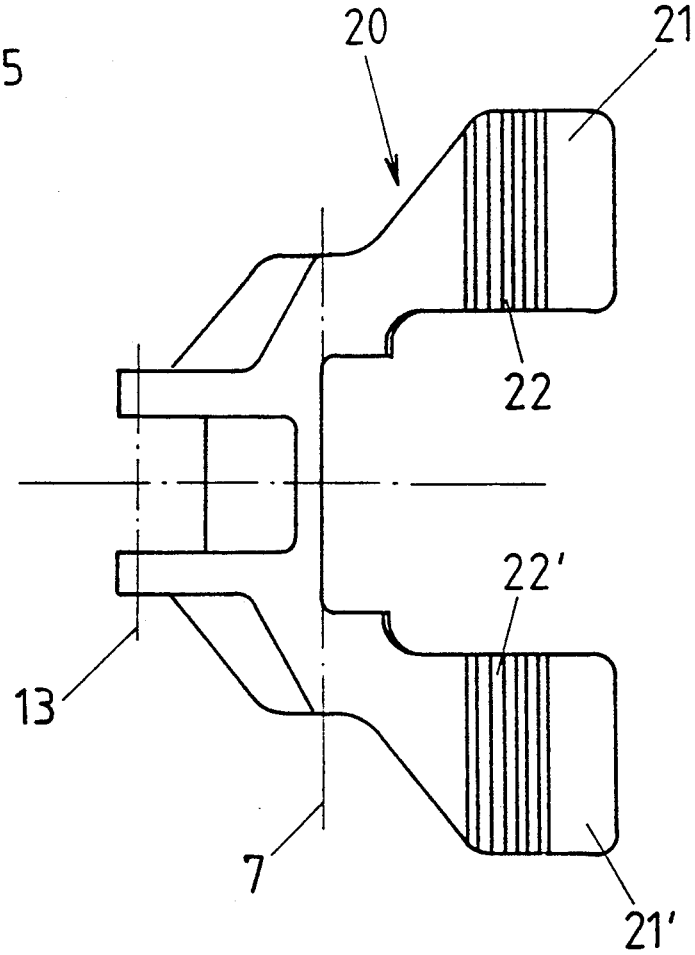
Fig. 6
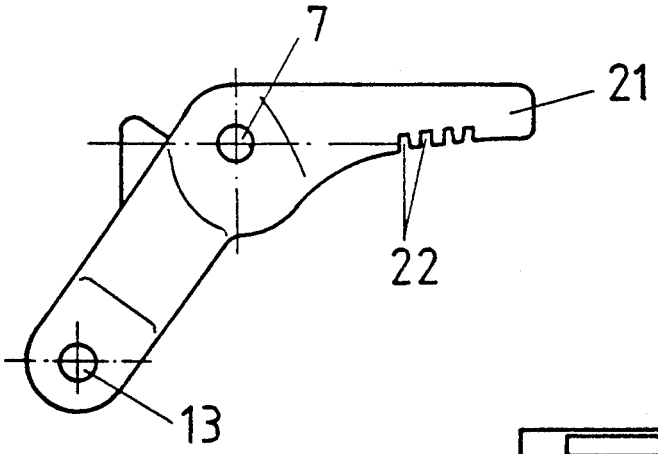
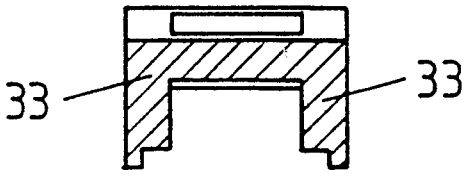
Fig. 11

BRAKING DEVICE FOR ROLLER SKATES AND SKATEBOARDS

BACKGROUND OF THE INVENTION

1. Field of the Invention

The present invention relates to a braking device for roller skates and skateboards, to be actuated by rocking the skate or the board towards the rear by the bearing on the ground of a wheel mounted for rotation at one of the ends of a lever element, the braking effect being obtained by friction of the other end of the lever element on each of the rear rollers of the skate or of the board 2. Description of the Related Art A braking device for roller skates of the aforementioned type is described in GB-A-25,730. Similar arrangements, in which a single fixed block element replaces the wheel mounted for rotation at the end of the lever element, are described in GB-A-11,117 and U.S. Pat. No. 1,456,881. These devices, of a very old design, are each conceived to comply with the functioning of a very specific type of roller skates They are fixed at the level of the axis of rotation of the rollers and it would only be possible with difficulty for them to be adapted to modern roller skates. Furthermore, they are of a relatively complex design and all comprise a spring element intended for the re-positioning of the device at its rest position after braking. As any spring element is liable, in time, to suffer from fatigue and lose its elasticity, the consequence thereof may be an alteration in the functioning of the device.

Most of the roller skates which are at present on the market are equipped with very rudimentary braking devices, since they are made in the form of simple rubber or synthetic plastic elements disposed in a fixed position at the front or at the rear of the skate and are intended for a braking by friction of the said element against the ground when the skate is respectively inclined towards the rear or towards the front. Such braking devices are not satisfactory because, unless the skater is experienced, they produce frequent losses of equilibrium which are caused by the sudden braking action which they cause. In addition, they very quickly become worn.

One device of the type as indicated above, but designed for modern roller skates, is described in the European Patent Application published under No. 0039935. This device forms an integral part of the axle which supports a pair of rollers. It is designed in such a manner that the lever element acts on the lateral faces of each of the rollers. It comprises a relatively large number of parts and, in particular, a spring element intended for restoring the device to a rest position after braking Another arrangement is described in the PCT international application published under No. WO 82/00770. Like the one previously mentioned, this device is fixed at the level of the axis of rotation of a pair of rollers It is also of a relatively complex design and likewise comprises a spring element intended for its return to a rest position.

SUMMARY OF THE INVENTION

It is the object of the present invention to propose a braking device for roller skates and skateboards which permit a rapid immobilization of the skate, without any danger of loss of equilibrium, such device comprising a limited number of parts which can be easily manufactured and which are able to be fitted on all modern skates or skateboards without any modification thereof.

To this end, the invention is concerned with a braking device for roller skates and skateboards, to be actuated by the rocking of the skate or board towards the rear by the bearing on the ground of a wheel mounted for rotation at one of the ends of a lever element, the braking effect being obtained by friction of the other end of the lever element on each of the rear rollers of the skate or board, characterized in that it comprises a base element adapted to be fixed to the rear part of the chassis of the skate or board, the lever element being mounted for rotation about an axle integral with the said base element, the assembly being so arranged that the lever element returns to the rest position by the sole effect of the weight of the wheel.

According to one embodiment form, the base element is fixed on the body of the skate or skateboard by means of the fixing screw of the axle of the rear rollers, the base element being able to comprise a flat end part having a hole intended for the passage of the fixing screw of the rear roller axle on the body of the skate or skateboard, the fixing of the base element then being able to be obtained by locking the said end part between the said body and the said axle.

The parts of the lever element intended for bearing by friction against the rollers may be of the same width as that of the rollers of the skate or skateboard and comprise lateral ridges.

The base element may comprise a recessed part which is adapted for the centering and the blocking of the braking device around the centering/blocking device of the rear roller axle.

The end part of the base element may comprise a projecting part of disc-like form disposed around the hole.

The arrangement may, for example, be made of metal or of a synthetic plastics material.

This arrangement has the advantage of being able to be fitted in a very simple manner, by anybody, this being achieved in a single operation on all modern roller skates and skateboards. It comprises a very limited number of parts, which can be easily produced Furthermore, the functioning thereof is not liable to be altered over a period of time, since it does not comprise any spring element for return to the rest position.

BRIEF DESCRIPTION OF THE DRAWINGS

The invention will be best understood by means of the description of one example of the braking device for roller skates, and by reference to the accompanying drawings, in which:

FIG. 5 is a view from below of a modified form of the lever element;

FIG. 6 is a side view of the lever element of FIG. 5;

FIG. 11 is a transverse vertical section along B—B of FIG. 8.

DESCRIPTION OF THE PREFERRED EMBODIMENTS

Figure 1:
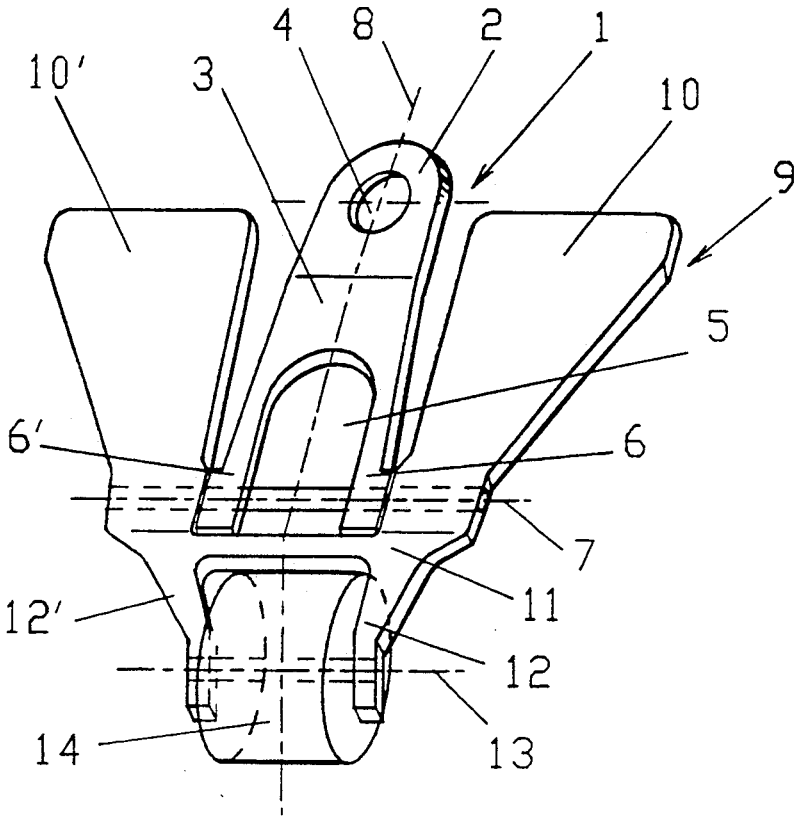
FIG. 1 is a perspective view of one diagrammatic example of the braking device, prior to being fitted on the skate.
Figure 3:
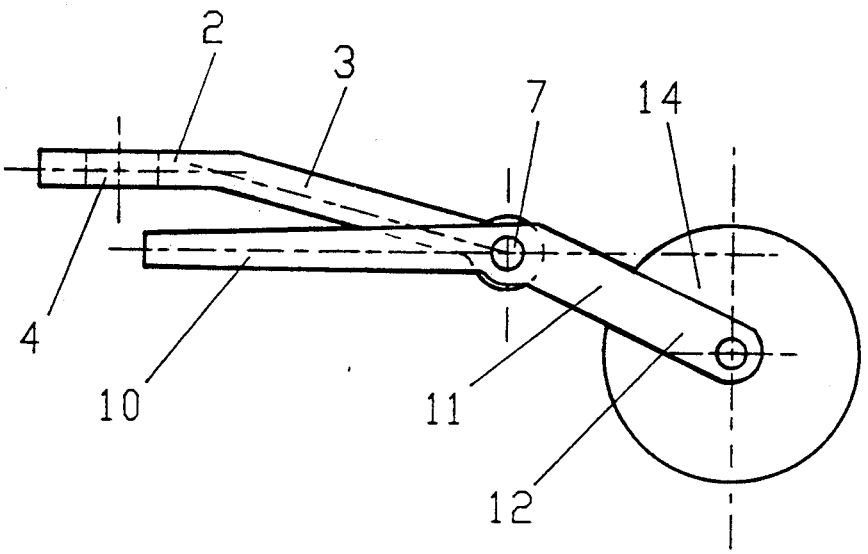
FIG. 3 is a side view of the device according to FIG. 1.
Figure 2:
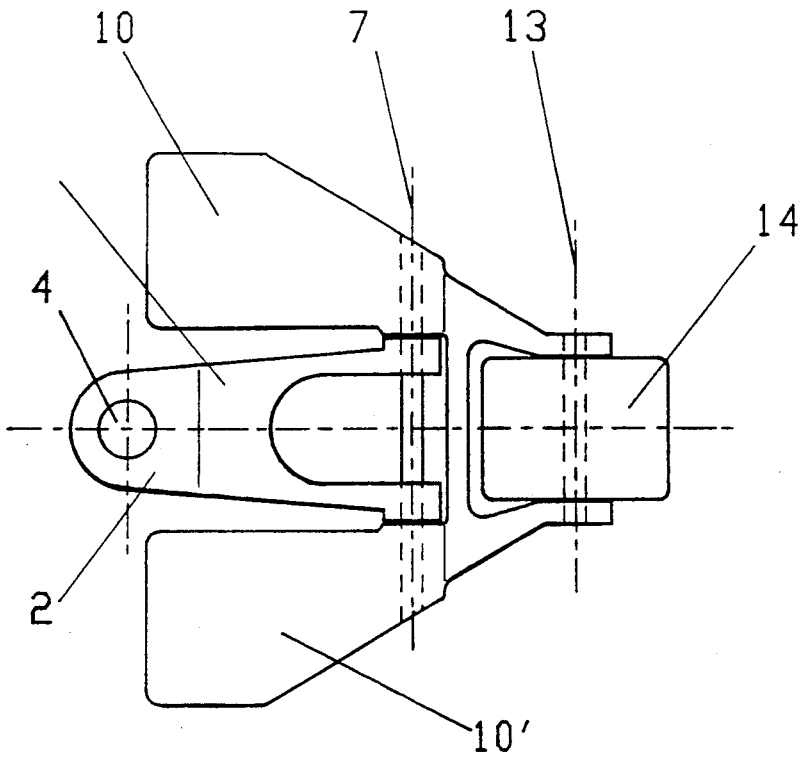
FIG. 2 is a plan view of the device according FIG. 1.
Figure 4:
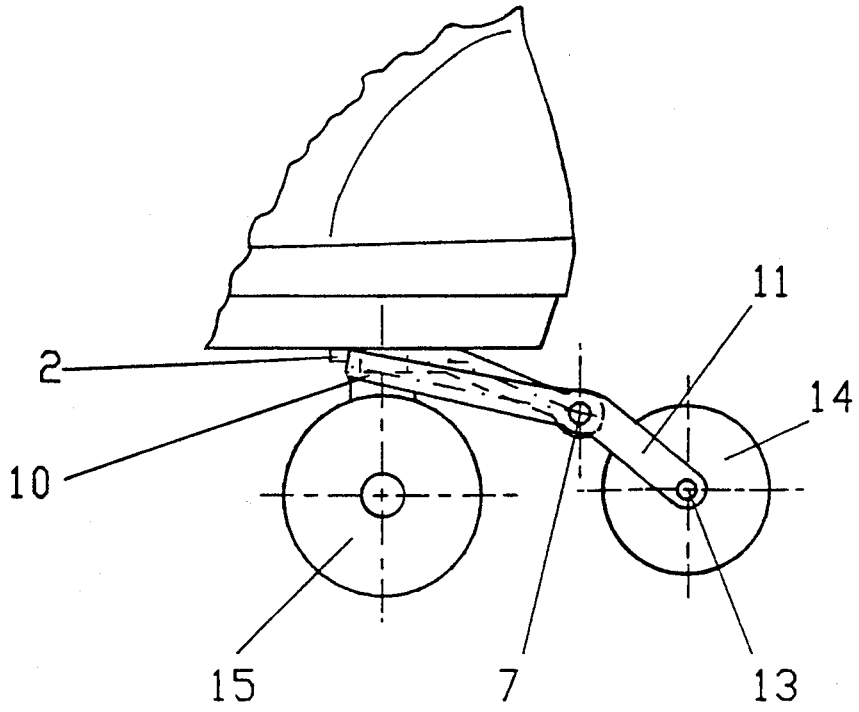
FIG. 4 is a side view of the device, after having been fitted on a roller skate.
Figure 7:
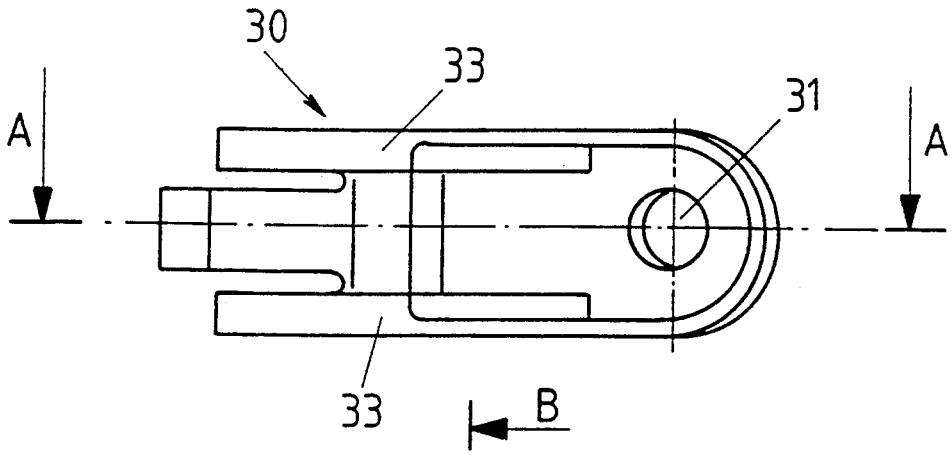
FIG. 7 is a view from below of a modified embodiment of the base element.
Figure 8:
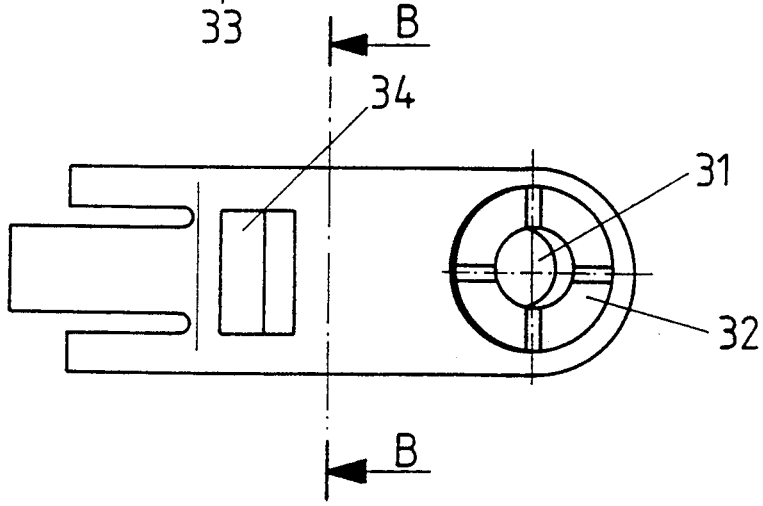
FIG. 8 is a view from above of the base element of FIG. 7.
Figure 9:
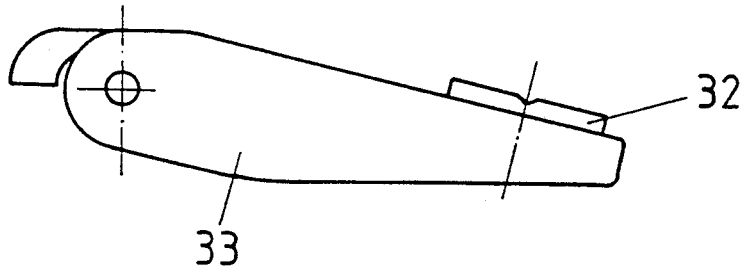
FIG. 9 is a side view of the base element of FIG. 7.
Figure 10:
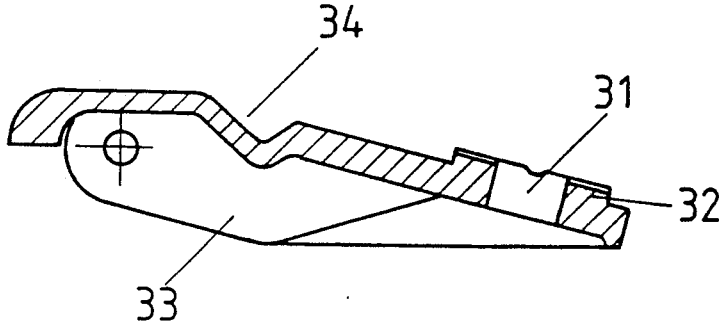
FIG. 10 is a longitudinal section along A—A of the base element of FIG. 7.

As shown in FIGS. 1 to 3, the braking device comprises a base element adapted to be fixed on the chassis of the roller skate A lever element 9 is mounted to be rotatable on the base element 1 about an axle element 7. A wheel 14 is mounted to be rotatable at one of the ends of the lever element, about an axle element 13. The base element comprises a first coupling part 2 having a flat surface and comprising a hole 4 intended for the fixing of the said base element on the skate, and a second part 3, inclined in the longitudinal direction with respect to the first part 2, and comprising a recessed part opening towards the outside, so as to decrease the amount of material and forming two branches, or arms 6, 6' and forming an empty space 5 which permits the centering and the locking of the braking device in position after having been fitted, in the same manner as the locking in position of the axle of the rear rollers Each of the arms 6, 6' is transpierced at its ends with a hole which extends laterally and is intended for the passage of the axle element 7 disposed perpendicularly with respect to the longitudinal axis of symmetry 8 of the arrangement. The lever element 9 comprises firstly two parts 10, 10' in the form of wings which are disposed longitudinally and symmetrically with respect to the axis of symmetry 8, and are so spaced that it is possible to insert between them the two arms 6, 6' of the base element Holes are also provided at the base of the said wing-shaped parts so as to permit the passage of the axle element 7, permitting the lever element 9 to carry out a rotation with respect to the base element 1. The lever element 9 also comprises longitudinally a part 11 inclined with respect to the parts 10, 10' and arranged in the form of a fork having two arms 12, 12' extending in the direction opposite to that of the wing-shaped parts 10, 10' and comprising transversely disposed holes at their ends, so as to permit the passage of the axle element 13, on which the wheel 14 is rotatably mounted.

The mounting of the braking device on the skate is effected in a very simple manner. It is sufficient to unscrew the axle of the rear rollers, to place the flat face of the part 2 of the base element against the skate chassis, while positioning the hole 4 so as to face the hole intended for the fixing screw of the said axle and to replace the axle, so as to immobilize the part 2 of the base element between the chassis and the axle with the aid of the fixing screw of the axle. In the rest position, i.e when the skate is in a horizontal position, the weight of the assembly formed by the wheel and the part 11 of the lever element being greater than the weight of the wings 10, 10' of the said lever element, the said wings are subjected to a thrust towards the top and assume a position abutting against the chassis of the skate. The dimensions and the positioning of the parts of the braking device are so chosen that the lowest point of the wheel 14 is situated substantially higher than the lowest point of the rollers 15 of the skate For braking purposes, it is sufficient to cause the skate to rock towards the rear, by raising the front of the skate. In this way, the wheel 14 comes to bear against the ground and causes the lever element 9 to rock about the axle 7, the wing-shaped parts 10, 10' then coming to bear on the rollers 15 of the skate. After braking, when the skate returns to its horizontal position, the braking device is automatically returned to the rest position under the effect of the weight of the wheel, as already previously mentioned A modified constructional form of the lever element is represented in FIGS. 5 and 6. The wing-shaped parts 21, 21' of the lever element 20 represented in these Figures comprise lateral grooves 22 disposed on their lower faces, so as to increase the friction effect on the rollers 15 of the skate or skateboard when braking A modified constructional form of the base element is shown in FIGS. 7 to 10. This base element likewise has a hole 31 intended for the fixing thereof on the skate. The general form of this base element is essentially different from that of the base element as previously described and is particularly adapted for being made of a plastics material. The element 30 comprises an incorporated washer element 32, disposed around the hole 31, so as to facilitate the adaptation of the base element to all commercial skates. Actually, this part, in the form of a washer, when it is made of a plastics material, is capable of being easily improved, for example, by filing or milling, before being fitted on to the skate. For reinforcing its rigidity, the element 30 comprises two longitudinal stiffeners 33. The hollow part 34 is adapted to replace the empty space 5 of the base element described in FIG. 1.

It is obvious that the examples of the braking arrangement as described above may be fitted on roller skates or skateboards. They may be made of any metallic material or, preferably, of a synthetic plastics material, this latter permitting a lighter construction which facilitates the freedom of movement of the user. They may comprise visible parts of vivid colour, or parts which are reflecting, phosphorescent or fluorescent, so as to make the skater more easily visible and to increase his safety in traffic As it is possible to see in the Figures, with the examples which are given, the wing-shaped parts 10, 21 of the lever elements have substantially the same width as the rollers, so as to increase the friction surface. Furthermore, their thickness will preferably be so calculated as to remain the thinnest possible, so as to permit a good cooling effect.

What is claimed is:

1. Braking device for roller skates and skateboards which comprise a chassis having a bottom surface, two front rollers mounted for rotation about a front axle fixed to the chassis bottom surface and two rear rollers mounted for rotation about a rear axle fixed under the chassis bottom surface, wherein said braking device comprises an elongated base element having a front end fixed to the chassis bottom surface and extending above the rear rollers and rearwards of the rear axle, and a rear end provided with an axle parallel to the axle of the rear rollers; an elongated lever element being mounted for rotation about said axle of said base element and having a front part and a rear part, said axle being arranged between said front part and said rear part of said lever, said rear part being provided with a wheel mounted for rotation on an axle provided at a rear end thereof and said front part being arranged to bear on at least one of the rear rollers, so that a braking effect is obtained by friction contact of said front part on at least one of the rear rollers, when the chassis is tilted with respect to the ground to place the front rollers at a sufficient distance above the ground so that said wheel bears on the ground and the rear part of the lever is tilted towards the chassis bottom surface, the assembly formed of said lever and said wheel being balanced such that said lever returns to a position in which said wheel is remote from the ground and the front part of the lever does not bear on either of the rear rollers when the chassis returns to a position parallel with the ground.

2. Braking device according to claim 1, wherein each of said base element and said lever element have an axis of symmetry extending parallel to the chassis longitudinal axis, the front part of said base element comprising a flat surface provided with means for fixing the base element to the chassis bottom surface, the rear part of said base element being bent downwards with respect to said front part and forming two arms the ends of which support the axle for rotation of said lever element, the front part of said lever element comprising two wings disposed symmetrically with respect to the axis of symmetry of said lever element, each of said wings being arranged to bear on one of said rear rollers when the lever front part is tilted away from the chassis, and the rear part of said lever element is arranged in the form of a fork having two arms between which said wheel is mounted for rotation on said axle.

3. Device according to claim 2, wherein said rear axle is fixed to the chassis and said base element is also fixed to the chassis, said flat surface of the front part of said base element being secured between the chassis and said rear axle.

4. Device according to claim 2, wherein said base element is made of plastic material and comprises a flat front part comprising a hole intended for the passage of the fixing screw of said rear axle on the chassis, said flat front part being secured between the chassis and said rear axle.

5. Device according to claim 2, wherein said base element is made of metal and comprises a flat front part comprising a hole intended for the passage of the fixing screw of said rear axle on the chassis, said flat front part being secured between the chassis and said rear axle.

6. Device according to claim 1, wherein said front part of said lever element arranged to bear on the rear rollers is provided with surfaces comprising lateral ridges, having the same width as said rear rollers, and adapted to come into contact with the peripheric surface of the rear rollers.

7. Device according to one of the claims 1, 4, or 5, characterized in that the base element comprises a means for centering and locking of the braking device in position.

8. Device according to one of the claims 3, 4 or 5, characterized in that a rear end portion of the base element comprises a projecting part of ring form (32).

9. Device according to claim 6, characterized in that the base element comprises a means for centering and locking of the braking device in position.

10. Device according to one of the claims 3, 4 or 5, characterized in that front parts (21) of the lever element adapted to be applied by friction onto the rear rollers are of the same width as that of the rollers of the chassis and comprise lateral ridges (22), the base element comprises a means for centering and locking of the braking device around the center of the axle of the rear rollers, and a rear end portion of the base element comprises a projecting part of ring form (32).

11. Device according to claim 6, characterized in that front parts (21) of the lever element adapted to be applied by friction onto the rear rollers are of the same width as that of the rollers of the chassis and comprise lateral ridges (22), and a rear end portion of the base element comprises a projecting part of ring form (32).

* * * * *

UNITED STATES PATENT AND TRADEMARK OFFICE

CERTIFICATE OF CORRECTION

PATENT NO. : 5,118,122

DATED : June 2, 1992

INVENTOR(S) : Henri Ricart

It is certified that error appears in the above-identified patent and that said Letters Patent is hereby corrected as shown below:

In column 1, line 58, please place a period between the words "rollers" and "It".

In column 3, line 11, please place a period between the words "skate" and "A".

In column 3, line 25, please place a period between the words "rollers" and "Each".

In column 3, line 34, place place a period between the words "element" and "Holes".

In column 4, line 5, please place a period after the word "mentioned".

In column 4, line 48, please change the word "comprise" to --comprises--.

Signed and Sealed this

Tenth Day of August, 1993

*Attest:*

Michael K. Kirk

MICHAEL K. KIRK

*Attesting Officer*

*Acting Commissioner of Patents and Trademarks*